United States Patent [19]

Shimek et al.

[11] 4,112,913

[45] Sep. 12, 1978

[54] FREE STANDING HEATING UNIT

[76] Inventors: Ronald J. Shimek, Rte. 3, Lakeview Dr., Prior Lake, Minn. 55372; Daniel C. Shimek, 2090 Fairmount, St. Paul, Minn. 55105

[21] Appl. No.: 777,688

[22] Filed: Mar. 15, 1977

[51] Int. Cl.[2] ..... F24B 1/18

[52] U.S. Cl. ..... 126/120; D23/97

[58] Field of Search ..... 126/120, 121; D23/97

[56] References Cited

U.S. PATENT DOCUMENTS

| | | | |
|---|---|---|---|
| 3,220,400 | 11/1965 | Yager | D23/97 |
| 3,339,540 | 9/1967 | Kreider | 126/121 |
| 3,499,432 | 3/1970 | Hannebaum | 126/120 |
| 3,515,122 | 6/1970 | Andrews | 126/120 |
| 3,768,457 | 10/1973 | Beasey | 126/120 |
| 3,910,251 | 10/1975 | Andrew | 126/120 |

*Primary Examiner*—Ronald C. Capossela

*Attorney, Agent, or Firm*—John B. Sowell

[57] ABSTRACT

A free standing heating unit is provided with a central forge draft intake and a circumferential edge draft intake in a firebox chamber. The central forge draft intake is provided in the center of the firebox chamber floor means and the circumferential edge draft intake is provided between the bottom of the radiant panels which form the sides of the firebox chamber and the top surface of firebox chamber floor means.

16 Claims, 7 Drawing Figures

FIG. 1
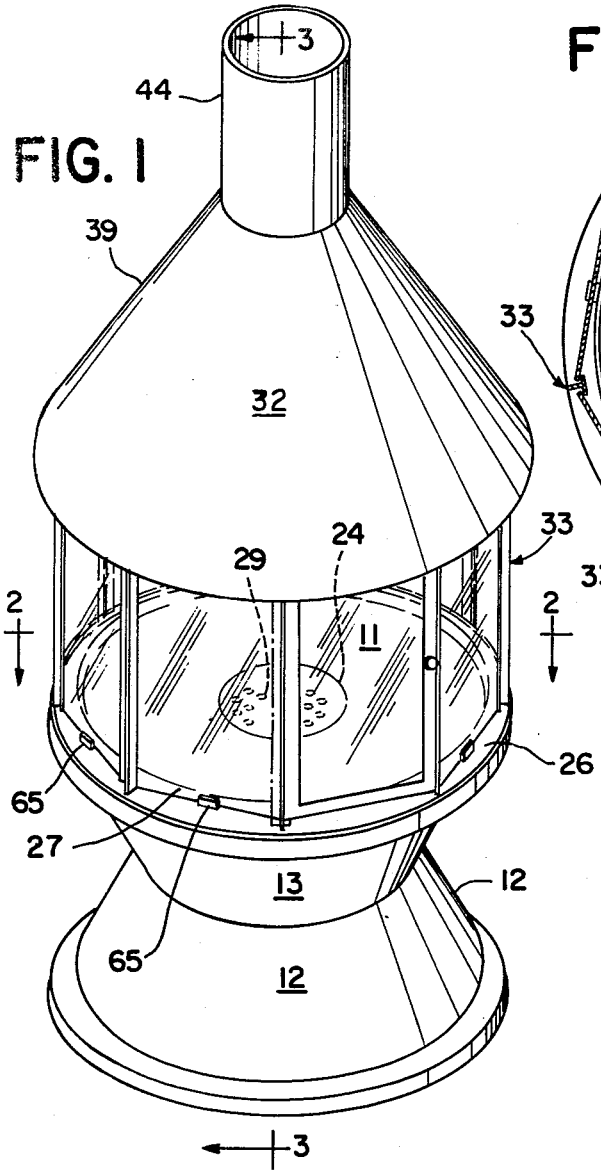
FIG. 2
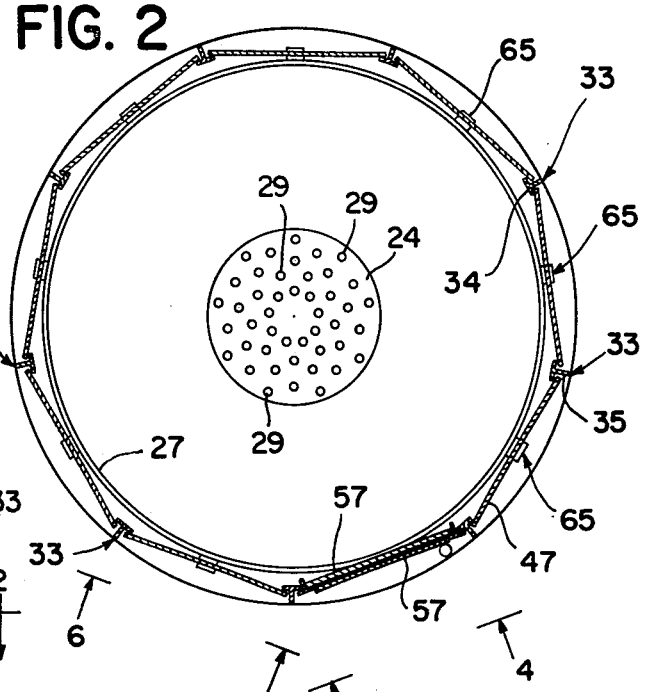
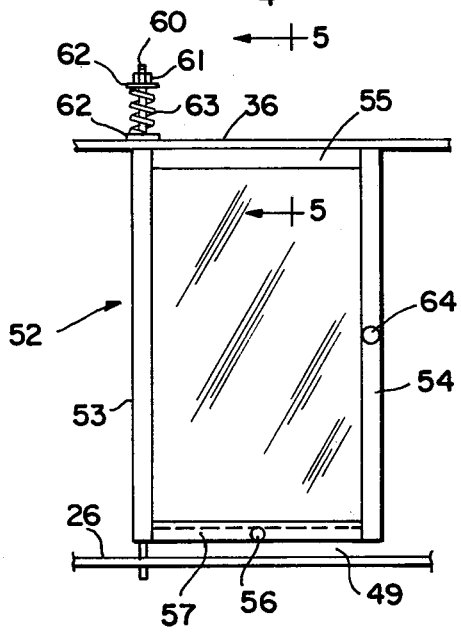
FIG. 4
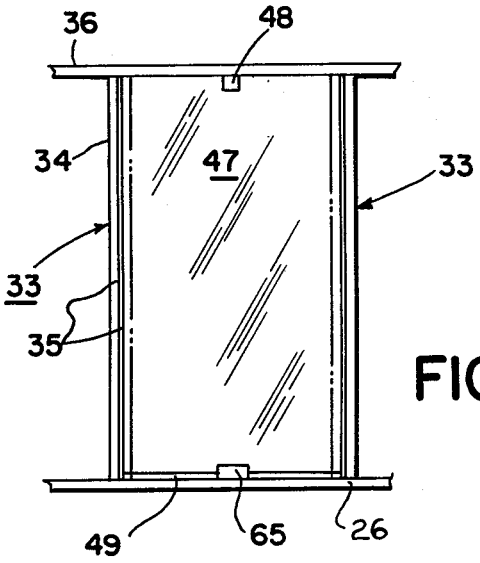
FIG. 6

FREE STANDING HEATING UNIT

BACKGROUND OF THE INVENTION

1. Field of the Invention

The present invention relates to heating units, and more particularly to free standing heating units adapted to efficiently heat by radiation as well as convecting the area surrounding the heating unit.

2. Description of the Prior Art

Freestanding heating units are well known and are generally classified in Class 126, subclass 120 under fireplaces and in subclass 121 under hot air fireplaces. The prior art freestanding heating units include space heaters and Franklin type stoves of the type adapted to burn efficiently several types of organic fuels.

Most iron and steel stoves have an inner firebox chamber separated from an outer shell by an air space. The major portion of the heating effect is accomplished by convection when the air rising between the firebox chamber and the outer shell is heated. The exhaust pipe or connection to the chimney is usually very short and sometimes heavily insulated thus assuring that most of the available radiant energy is lost.

Gas radiant heaters of the prior art types are similar in mode of operation to open fireplaces in that one side of the heater or fireplace is open to freely radiate heat of combustion. Open gas radiant heaters are usually not vented and have been known to consume the oxygen in a room in a short period of time and/or to fill the room with carbon monoxide which causes permanent brain injury or death. If such open gas radiant heaters are not supplied with adequate vents and adequate protective coverage of the open flame they present serious hazards.

Open fireplaces are assumed to have vents which connect to the outside of the building in which they are installed. Open fireplaces have been provided with mesh cover screens and even fireproof glass to protect against discharge of embers from the fuel being burned. Open fireplaces are not provided with efficient burner controls and are known to be generally inefficient unless provided with expensive auxilliary convection heating means.

Completely free standing heating units such as those described in U.S. Pat. No. 3,499,432 are known. The firebox chamber of such units are provided with panes of glass which substantially comprise the side walls of the firebox chamber. When fuels other than natural gas or synethetic gas are burned in the firebox chamber, the unburned carbon in the combustion gasses is known to deposit rapidly on the panes of glass. Smoked glass causes loss of radiant heat, excessive heating of the glass, seriously detracting from the artistic beauty of unit and the ability to observe the fire.

To overcome the problem of producing smoked glass, the heating unit described in U.S. Pat. No. 3,499,432 is provided with a plurality of vertically hinged windows or doors which, when opened, permit a circumferential flow of air across the inside face of the glass panels. A circumferential flow of combustion gasses is induced by a fire ring which introduces a circumferential ring of air adjacent the base or floor of the fire box.

Such prior art heating units, to burn effectively present an excessive amount of air surrounding the fuel and an insufficient amount of air in the center of the fuel being burned. Further, the open doors or windows permit sparks and flaming embers to pop or discharge out of the firebox chamber onto the floor. Heating units having framed glass doors and windows are expensive to manufacture and require factory made parts for service. Fixed solid bottom fireboxes and/or open sided air intakes in fireboxes are known to be difficult to clean as well as to service.

There is an unfulfilled need in art of heating units for a highly efficient combustion unit capable of burning wood, coal, rolled paper, gas and other forms of fuel interchangably.

SUMMARY OF THE INVENTION

The present invention heating unit provides a highly efficient free standing fireplace which may be used for heating a large room or a small home while providing light and decorative beauty.

It is a primary object of the present invention to provide a firebox chamber of the type having glass sides to permit maximum radiant heating and efficient convection heating.

It is another principal object of the present invention to provide means for efficiently controlling the amount of air presented to the fuel being burned and simultaneously restricting the flow of the gases of combustion away from glass sides.

It is another object of the present invention to provide a heating unit having easily accessibly components designed to be reliable in use and economical to replace.

In accordance with these and other objects of the present invention there is provided a free standing heating unit having a firebox chamber supported on a pedestal base and having a frustro-conical dome adapted to be connected to a chimney. The sides of the firebox chamber are provided with removable glass panels having an air intake space at the bottom edge which permits air to rise across the inside face of the glass panels as well as to provide air for combustion of fuel located in the center of the firebox chamber. The bottom of the firebox chamber is provided with a central aperture connected to a controlled air intake damper for independently controlling the rate of combustion of the fuel.

BRIEF DESCRIPTION OF THE DRAWINGS

FIG. 1 is an isometric view of the novel freestanding fireplace of the present invention.

FIG. 2 is an enlarged section in plan view taken at lines 2—2 of FIG. 1.

FIG. 4 is an enlarged elevation view of the door of the fireplace of FIG. 1 taken at lines 4—4 of FIG. 2.

FIG. 6 is an enlarged elevation view of one of the removable fireproof glass panels taken at lines 5—5 of FIG. 2.

DESCRIPTION OF THE PREFERRED EMBODIMENT

Figure 3:
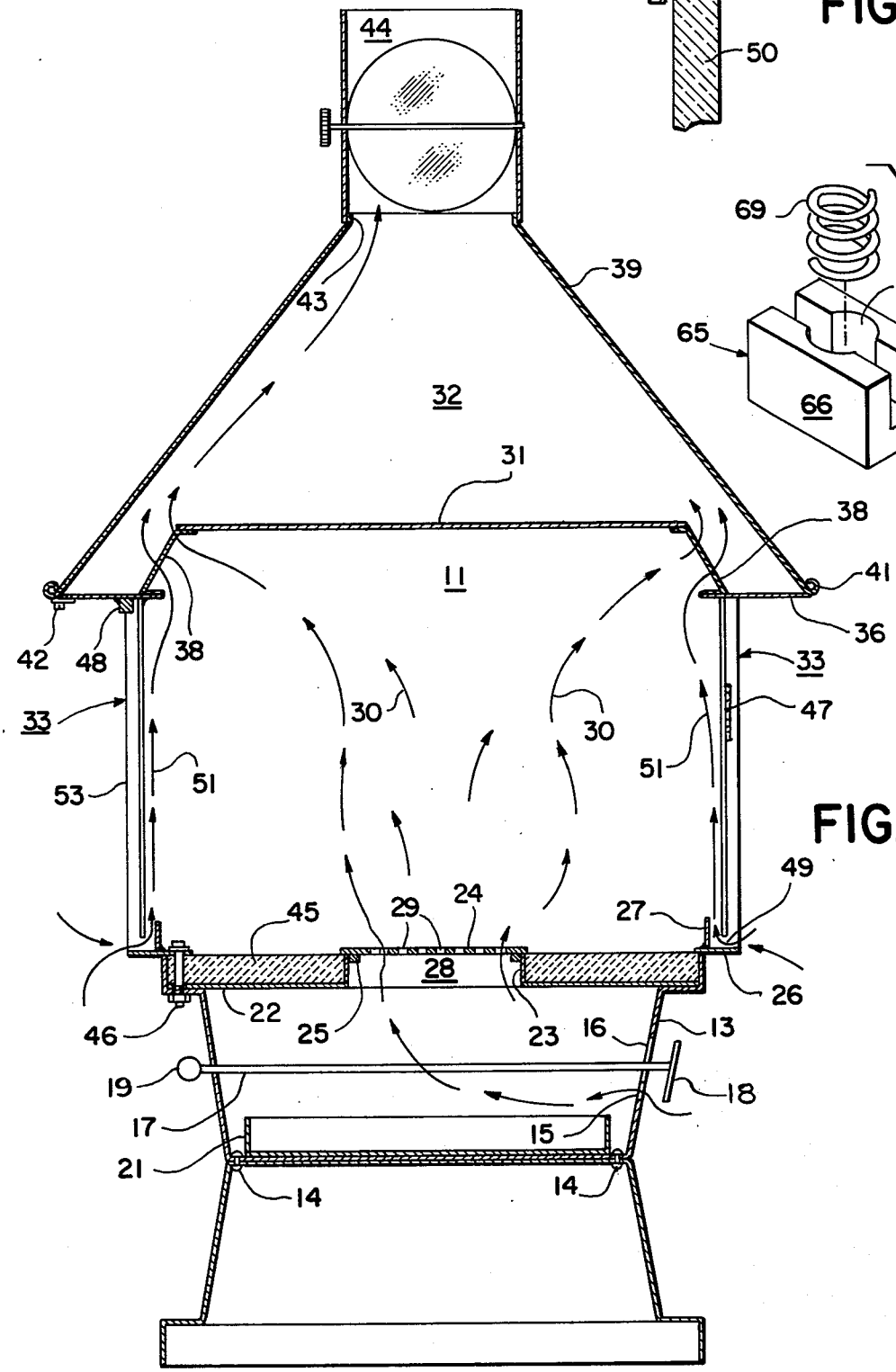
FIG. 3 is an enlarged section in an elevation view taken at lines 3—3 of FIG. 2

Refer now to FIGS. 1 to 3 showing the novel firebox chamber 11 mounted on a base which comprises a lower base member 12 and an upper base member 13. The base members 12, 13 are preferably connected by rivets 14 but could be connected by welding or other means. The base members 12, 13 have an identical shape and are adapted to be made from structural channels and plate members or to be spin formed from a single sheet of metal. The upper base member 13 is provided with a rectangular shaped aperture 15 which has a support finger 16 extending into the aperture 15 for supporting the damper control rod 17. The damper control rod 17 supports thereon a damper closure plate 18 at one end and has a removable control knob 19 fastened on the other end. When the control knob 19 is removed, the control rod 17 may be pulled through the side of base 13 and through finger 16 leaving the large rectangular aperture 15 open so that ash tray 21 may be removed from inside the support floor of upper base member 13. The shape of aperture 15 may be so designed to permit easy removal of the ash tray 21.

Aperture 15, control rod 17 and damper closure plate 18 comprise a forge draft inlet or air damper intake for the central forge. As will be explained hereinafter, the damper closure plate may be completely closed for minimum burning without putting out the fire.

An annular shaped floor plate 22 is supported by and mounted on the outer annular step shape portion of base member 13. The annular floor plate 22 is designed to fit tightly in the annular step and to provide a tight closure therebetween. A vertical cylindrical ring 23 is attached to the inner edge of the annular floor plate 22 by welding or by other appropriate means to form a strong connection therebetween. A perforated (or apertured) grate 24 is supported on top of vertical ring 23 and may be welded thereto or provided with guide keepers 25 connected to the grate 24 which center the grate 24 and permit the grate to be removed. An outer annular ring 26 may be made as an integral part of base 13 or as a separate part welded thereto as a horizontal annular support ring 26. A second vertical cylindrical ring 27 is connected by welding to annular ring 26 to provide a deflector plate which is high enough to deflect embers and sparks to prevent them from escaping from the firebox chamber 11. Ring 27 is substantially rigid and also serves as a keeper or deflector plate to retain logs and other forms of combustible fuel from sliding sideways and making engagement with the fireproof glass used in the doors and the panels. Vertical cylindrical ring 27 also serves as a deflector plate for directing air which is entering into the firebox chamber from a horizontal direction to a substantially vertical direction as will be explained hereinafter.

In the preferred mode of operation, the fuel to be burned is placed on or around grate 24 in a central location of the firebox chamber 11 so that air which is entering through the forge draft inlet aperture 15 will be supplied directly to the forge draft aperture 28 where it passes through the apertures 29 of grate 24 to enter the center of the fire. The air entering the firebox chamber 11 through apertures 29 provides the oxygen for combustion of the fuel and the combustion gases are swept initially vertically upward until the gases are at or near horizontal deflector plate 31 of dome means 32. The gases then pass radially outward and around plate 32 so that they rise along the inside of dome means 32 as shown by the arrows 30. Dome means 32 are supported on vertical columns 33. The T-shaped structural columns 33 have horizontal webs 34 and vertical webs 35. The base or bottom end of vertical columns 33 are connected preferably by welding, to annular ring 26. The top portion of vertical columns 33 are connected, preferably by welding, to annular top ring 36 which comprises a part of dome means 32. Three or more channel shaped members 38 are connected, preferably by welding, between horizontal annular top ring 36 and deflector plate 31 to provide a rigid support therefor and an integral rigid top frame structure for firebox chamber 11.

Truncated cone 39 of dome means 32 is supported on the outer perimeter of annular top plate 36 and is provided with an ornamental or decorative curled edge 41. The lower curled edge 41 of cone 39 may be welded to annular top plate 36 or may be connected thereto by metal screws 42 as shown. Cone 39 may be shaped by roll forming a segment of metal plate or by spin forming a disk shaped plate. Vertical stack 43 may be formed as an integral part of cone 39 or is preferably made as a chimney pipe connected to cone 39. An upper damper assembly 44 is preferably provided in the exhaust or chimney pipe leading to the exhaust vent or the outside chimney (not shown). It will be understood that the forge draft inlet described herein before is employed as the forge draft air inlet and that the upper damper 44 preferably is opened when the fire is in the firebox chamber 11 and is closed to seal off the outside air when the firebox chamber 11 is not in operation.

A refractory material 45, preferably molded in place, may be poured on top of floor support plate 26. The refractory material may be provided as a dry powder which is mixed with water and then poured as an insulating cement mixture and allowed to harden and form a continuous firebrick which is annular shaped and serves also as a heat sink and insulating floor.

Alternatively, the insulating floor 45 may be made from precast segment shaped bricks, in which event apertures are preferably provided through the bricks to permit the insertion of bolts 46 which extend through an inner edge extension of the annular ring 26 and the step shape portion of upper base member 13. Annular ring 26 and the upper edge of base member 13 may be reinforced to make the connection substantially rigid so that bolts 46 may not be required.

Structural T-shaped columns 33 are provided with vertical webs 35 which form separators for radiant panels 47. The horizontal webs 34 of columns 33 form vertical edge mounting restraints for the vertical edges of radiant panels 47. To keep the radiant panels 47 from inadvertently moving outward, a plurality of upper keepers 48, at least one for each panel, are connected to upper annular top plate 36 preferably by welding, however, metal screws or appropriate fasteners may be employed. Radiant panels 47 may be made from an opague material, a translucent material or from transparent material. Preferably the panels are made of strong structural materials or fire-proof glass which is not easily broken. In the preferred embodiment shown panels 47 do not require structural frames to preserve their strength or insure against breakage. Individual panes of fire-proof glass 47 may be tilted inward at an angle so that the upper edge may be placed between a keeper 48 and the upper edges of webs 34 of columns 33. The glass panel 47 is then urged into engagement with plate 36 and is brought into mating engagement with the vertical sides of web 34 leaving a horizontal slit or aperture 49 between the bottom edge of the panel 47 and the annular ring 26. Outside air is drawn through apertures 49 and comprises an edge draft inlet. The air being drawn through the aperture 49 engages deflector plate ring 27 which causes the entering air to be deflected and rise substantially vertically along the inside of radiant panels 47 thus, keeping the panels from overheating or becoming discolored by smoke. It has been determined that an aperture or slit 49 approximately one-half inch wide provides a desirable edge draft inlet for the free-standing fireplace shown. This inlet draft has been determined to be sufficient to maintain a cylindrical tube of protective air on the inside face of the panels of the firebox chamber 11 which prevents overheating or smoke discoloration of the glass panels 47. When the central forge damper plate 18 is completely closed, the edge draft inlet air entering aperture 49 is pulled further toward the center of the firebox chamber 11, but is sufficient to supply adequate air for a normal low burning rate of fuel placed on or about grate 24. Since the edge draft inlet air entering aperture 49 is pulled to the center of the chamber 11, it will also hold or contain the smoke from the fire to the center of the firebox chamber 11, thus, preventing overheating or discoloration of the glass panels 47.

Figure 5:
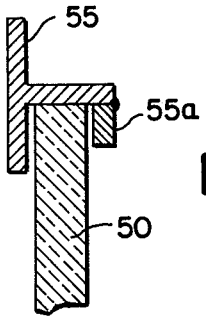
FIG. 5 is a section taken at lines 5—5 of FIG. 4 through a top frame of the door.

FIG. 4 shows a detail of a preferred embodiment door 52 which is provided with a center glass panel 50 protected by a metal frame. The vertical frame side members 53 and 54 are T-shaped in cross section and have their vertical webs directed radially inward as best shown in FIG. 2. The upper horizontal door frame cross member 55 is connected, as by welding, to the vertical frame members 53 and 54. Horizontal member 55 may be T-shaped and is provided with a rectangular keeper block 55A fixed to the vertical web of the T-shaped member 55 as best shown in FIG. 5. Lower horizontal frame member 56 comprises a pair of spaced apart parallel rectangular plates 57 which are connected to the side frame members 53 and 54 preferably by welding. A glass panel 50 is adapted to slide between parallel plates 57 and to engage its top edge against upper horizontal frame member 55 so that it is captured by keeper 55A. The lower edge of panel 50 may be held in place by inserting a plastic coated screw 56 or other appropriate shock resistant stop members through the parallel plates 57.

Door 52 is further provided with a lower pivot shaft 58 connected to the vertical frame member 53 and with an upper pivot 59. Upper pivot 59 comprises a threaded rod 60 which is fixed, preferably by welding, to vertical frame member 53 and is provided with a threaded nut 61 on the free end. Threaded rod 60 passes through an aperture (not shown) in annular plate 36. A pair of friction washers 62 are separated by a compression spring 63 on rod 60. The upper edge of horizontal frame member 55 is held in friction engagement with the bottom of annular plate 36 when nut 61 is tightened to cause spring 63 to have sufficient compression to support door 52. Nut 61 may be tightened to adjust and increase the friction between the door 52 and the plate 36. It will be understood that the lower edge of frame member 57 is also positioned above annular ring 26 so as to provide an edge draft intake aperture 49 similar to that described with reference to panels 47. A door knob 64 is preferably connected to vertical frame member 54 to enable the door 52 to be opened when access to the inside of firebox chamber 11 is required. Under normal operation the door 52 is kept closed.

Figure 7:
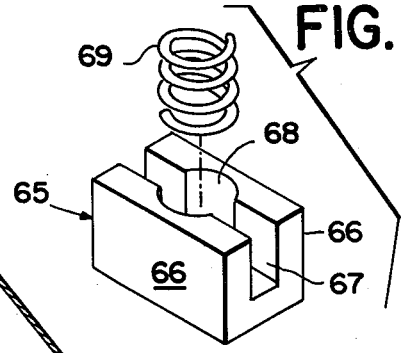
FIG. 7 is an isometric view of a preferred embodiment glass panel support means.

Refer now to FIGS. 6 and 7 showing details of a preferred embodiment glass panel 47 and the support means for panel 47. The glass panel 47 is preferably cut to a width which is slightly smaller than the distance between vertical webs 35 of adjacent T-shaped vertical columns 33 so that there is no possibility of causing the glass panel means to break due to thermal expansion or movement. The vertical edges of glass panels 47 are mounted in face-to-face or surface-to-surface edge contact with the exposed horizontal webs 34 of the T-shaped vertical columns 33. The vertical webs 35 of column 33 provide spacer means to maintain panels 47 in a loose or spaced adjustment between adjacent columns 33.

A preferred structure for supporting a frameless glass panel 47 is provided by resilient spring means 65, as best shown in FIG. 7. The support member or support block 66 may be machined from a rectangular or channel shaped block 66. Slot 67 in block 66 is preferably 1/16 inch wider than the glass panel 47 to be supported and accommodated therein. The block 66 is counterbored with a cylindrical recess 68 for receiving spring 69 therein. Spring means 65 comprising the spring 69 and block 66 may be fixed in place on annular ring 26 by a fastening screw (not shown) in the bottom of recess 68 which screws into ring 26. Spring 69 is of sufficient strength to support the weight of glass panel 47. The slot 67 in block 66 is deeper than the slot provided by keeper 48. A preferred manner of installing or replacing a glass panel 47 is to grasp both sides of the glass panel 47 and to press it into slot 67 deep enough to permit the top edge of panel 47 to clear keeper 48 when it is tilted inward. When the top edge of panel 47 clears the edge of keeper 48 it can be removed from the block 66 or placed behind the keeper 48. It will be understood that glass panels 47 float on spring 69 and are not restricted at the top or the sides. The bottom edge of panels 47 are also spaced apart from ring 26 providing an edge draft aperture 49.

Having explained a preferred embodiment of the present invention it will be understood that the edge draft apertures 49 preferably form a cylindrical ring around the firebox chamber 11 which supplies sufficient air to support a low rate of combustion of the fuel in the fireplace when the door 52 and the forged draft damper into the grate is closed. In a modified embodiment it may be desired to install some panels 47 which have no apertures 49. In such event it is desirable to increase the depth of apertures 49 of the other open panels to compensate for the partial closure. Panels 47 need not be translucent or transparent, thus, it is possible to install solid reflective metal panels 47 along the side of the firebox chamber 11 to provide a plurality of radiant panels which enhance the amount of radiant energy transmitted in a preferred direction through the transparent panels 47 on the sides opposite the reflective panels.

The resiliant spring means 65 for supporting panels 47 may be replaced by heat resistant plastic blocks or by heat resistant rubber blocks which support a bottom edge of glass panels 47. The blocks need not be fixed to ring 26 if the blocks are made of a material having sufficient friction to maintain panels 47 in place against columns 33.

A distinct advantage of the present fireplace is that the panels 47 are not placed in frames and can be easily purchased from a hardware store. No special tools are required to mount a glass panel 47 in the novel fireplace. The fact that panels 47 are easily removable also permits them to be cleaned while out of the fireplace. Opaque panels and decorative panels 47 may be inserted in the novel fireplace to conform to different room conditions. The novel fireplace is adapted to have insulative panels 47 inserted along a side of the fireplace in a room in which furniture is in close proximity to the fireplace or the fireplace is in close proximity to a wall of the room.

As long as some of the panels are provided with an edge draft intake there is no chance of causing the fire in the firebox chamber to suddenly discharge outward as would occur with fireplaces where all the air can inadvertently be closed off.

We claim:

1. A free standing heating unit comprising:
base support means having a draft inlet therein,
a firebox chamber mounted on said base support means and having;
a substantially annular ring shaped floor means mounted on said base support means forming the floor of said firebox chamber,
an apertured grate mounted on said ring shaped floor means providing a central forge draft intake therethrough,
an outer vertical ring shaped deflector plate mounted on said ring shaped floor means,
a plurality of vertical columns mounted at the outer circumference of said floor means,
dome means mounted on said vertical columns forming the top and the outlet of said firebox chamber,
radiant panels mounted between adjacent vertical columns forming the sides of said firebox chamber, and
means supporting said radiant panels and for providing a horizontal space between the bottom of said radiant panels and said annular ring shaped floor means, whereby there is provided a horizontal edge draft intake through said space which confines the fire and smoke to the center of said firebox chamber.

2. A free standing heating unit as set forth in claim 1 wherein said dome means comprises a truncated cone shaped exhaust hood, and an annular base ring extending radially inward from the base of said truncated cone mounted on said vertical columns.

3. A free standing heating unit as set forth in claim 1 wherein said outer vertical ring shaped deflector plate is positioned inside and opposite the bottom portion of said radiant panels and is higher in the vertical direction than said space at the bottom of said radiant panels thereby providing a vertical edge draft intake path therebetween.

4. A free standing heating unit as set forth in claim 1 wherein said radiant panels comprise panes of fireproof glass which float on springs.

5. A free standing heating unit as set forth in claim 4 which further includes top brackets for keeping the top edge of some of said radiant panels from moving radially outward away from said vertical columns, and said vertical columns are provided with vertical and horizontal webs for maintaining the vertical edges of said radiant panels in a fixed position.

6. A free standing heating unit as set forth in claim 1 wherein said vertical columns comprise T-shaped structural members having vertical webs of the T pointing radially outward, and having horizontal webs normal thereto, and wherein some of said radiant panels consist of fireproof glass mounted against the horizontal webs of said T-shaped members.

7. A free standing heating unit as set forth in claim 6 which further includes top brackets mounted on said dome means for urging the sides of said fireproof glass panels into engagement with the horizontal webs of said T-shaped members.

8. A free standing heating unit as set forth in claim 7 wherein said means for supporting said fireproof glass radiant panels comprise channel shaped blocks having resilient means in the bottom of the channels for urging the top edge of said fireproof glass panels into engagement with said dome means and for supporting said bottom edge of said fireproof glass above said floor means, whereby said fireproof glass panels are easily removable for cleaning or replacement.

9. A free standing heating unit as set forth in claim 1 wherein said means for supporting said radiant panels comprise spring means urging said radiant panels into engagement with said dome means and for supporting said radiant panels above said floor means.

10. A free standing heating unit as set forth in claim 9 wherein at least one of said radiant panels comprise a door mounted on a vertical pivot between a pair of adjacent columns.

11. A free standing heating unit as set forth in claim 1 wherein said substantially annular ring shaped floor means comprises an annular plate mounted on said base support means and an annular refractory heat sink mounted on said annular plate.

12. A free standing heating unit as set forth in claim 1 wherein said draft inlet in said base support means comprises a slot in the side of said base support means, and draft inlet control means comprising an adjustable closure juxtaposed said slot.

13. A free standing heating unit as set forth in claim 12 which further includes an ash tray supported in said base support means directly below said aperatured grate, said ash tray being of a size and shape to be removable through said slot in the side of said base support means.

14. A free standing heating unit as set forth in claim 1 wherein some of said radiant panels comprise removable fire proof glass panels.

15. A free standing heating unit as set forth in claim 14 wherein at least one of said removable fire proof glass panels comprise a hinged door having a spring support and friction closure means for maintaining said door in a closed position during operation.

16. A free standing heating unit as set forth in claim 15 wherein said removable fire proof glass panels consist of unframed glass panels supported on resilient keepers.

* * * * *